US012460331B1

(12) United States Patent
Shen et al.

(10) Patent No.: US 12,460,331 B1
(45) Date of Patent: Nov. 4, 2025

(54) RIGHT-ANGLE NEEDLE-PUNCHING MECHANISMS AND NEEDLE-PUNCHING DEVICES

(71) Applicant: Q-CARBON MATERIAL CO., LTD., Shanghai (CN)

(72) Inventors: Fuqiang Shen, Shanghai (CN); Yalin Sun, Shanghai (CN)

(73) Assignee: Q-CARBON MATERIAL CO., LTD., Shanghai (CN)

( * ) Notice: Subject to any disclaimer, the term of this patent is extended or adjusted under 35 U.S.C. 154(b) by 0 days.

(21) Appl. No.: 19/248,424

(22) Filed: Jun. 24, 2025

Related U.S. Application Data

(63) Continuation of application No. PCT/CN2025/086937, filed on Apr. 2, 2025.

(30) Foreign Application Priority Data

Nov. 13, 2024 (CN) ..... 202411614416.2

(51) Int. Cl.
*D04H 18/02* (2012.01)

(52) U.S. Cl.
CPC ..... *D04H 18/02* (2013.01); *D10B 2505/02* (2013.01)

(58) Field of Classification Search
CPC ..... D04H 18/02; D04H 18/00; D04H 1/4242; D04H 1/46; D04H 3/103; D04H 3/105;
(Continued)

(56) References Cited

U.S. PATENT DOCUMENTS 3,909,891 A * 10/1975 Dilo ..... D04H 18/02 28/109
4,621,662 A * 11/1986 Olry ..... D04H 18/02 156/425

(Continued)

FOREIGN PATENT DOCUMENTS

CN 109853138 A 6/2019
CN 109898238 A 6/2019

(Continued)

OTHER PUBLICATIONS

First Office Action in Chinese Application No. 202411614416.2 mailed on Dec. 18, 2024, 11 pages.

(Continued)

*Primary Examiner* — Amy Vanatta
(74) *Attorney, Agent, or Firm* — PORUS IP LLC

(57) ABSTRACT

A right-angle needle-punching mechanism and a needle-punching device are provided. The right-angle needle-punching mechanism includes a first right-angle needle-punching assembly and a second right-angle needle-punching assembly, a position adjusting assembly configured to drive the first right-angle needle-punching assembly and the second right-angle needle-punching assembly approach or move away from the preform, and an angle adjustment assembly configured to change needle-punching angles of the first right-angle needle-punching assembly and the second right-angle needle-punching assembly. The angle adjustment assembly, the first right-angle needle-punching assembly, and the second right-angle needle-punching assembly are arranged on the position adjusting assembly. The first right-angle needle-punching assembly includes a first right-angle needle plate, the second right-angle needle-punching assembly includes a second right-angle needle plate, and the first right-angle needle plate (Continued)

and the second right-angle needle plate perform needle punching on respective sides of the right-angle part of the preform.

8 Claims, 10 Drawing Sheets

(58) Field of Classification Search
CPC .... D04H 5/02; D04H 13/005; D10B 2101/12; D10B 2505/02
USPC ..... 28/107, 109, 110, 113, 115
See application file for complete search history.

(56) References Cited

U.S. PATENT DOCUMENTS 5,226,217 A * 7/1993 Olry ..... D04H 18/02 28/107
5,509,185 A * 4/1996 Petkov ..... D05C 15/20 29/282
5,772,821 A * 6/1998 Yasui ..... D04H 18/00 442/205
5,914,002 A * 6/1999 Cahuzac ..... D04H 3/002 156/92
2007/0090564 A1* 4/2007 Delecroix ..... D04H 3/002 264/258
2015/0299920 A1* 10/2015 Yanamoto ..... D04H 1/76 264/103
2018/0274144 A1* 9/2018 Evrard ..... D04H 1/46
2023/0295849 A1* 9/2023 Deng ..... D04H 18/02 28/107
2024/0141571 A1* 5/2024 Pujar ..... B25J 15/0071
2024/0158970 A1* 5/2024 Pujar ..... D04H 18/02
2025/0109537 A1* 4/2025 Clarke ..... D04H 1/46

FOREIGN PATENT DOCUMENTS

CN 209619604 U * 11/2019
CN 110629407 A 12/2019
CN 111101294 A 5/2020
CN 210505394 U 5/2020
CN 212582128 U * 2/2021
CN 214168333 U 9/2021
CN 113564815 A 10/2021
CN 113969466 A * 1/2022 ..... D04H 18/02
CN 115125670 A 9/2022
CN 219315220 U 7/2023
CN 116947520 A 10/2023
CN 220284366 U 1/2024
CN 117488485 A 2/2024
CN 118360730 A 7/2024
CN 118600649 A 9/2024
CN 119145128 A 12/2024

OTHER PUBLICATIONS

Decision to Grant a Patent in Chinese Application No. 202411614416.2 mailed on Jan. 28, 2025, 5 pages.

* cited by examiner

A

RIGHT-ANGLE NEEDLE-PUNCHING MECHANISMS AND NEEDLE-PUNCHING DEVICES

CROSS-REFERENCE TO RELATED APPLICATIONS

This application is a Continuation of International Application No. PCT/CN2025/086937, filed on Apr. 2, 2025, which claims priority to priority to Chinese Patent Application No. 202411614416.2, filed on Nov. 13, 2024, the entire contents of each of which are hereby incorporated by reference.

TECHNICAL FIELD

The present disclosure relates to a field of production equipment for carbon fiber products, and in particular, to a right-angle needle-punching mechanism and a needle-punching device.

BACKGROUND

Carbon/carbon (C/C) composites are carbon matrix composites reinforced by carbon fibers and their fabrics, which have excellent properties such as high strength, high modulus, high fracture toughness, high thermal conductivity, excellent thermal insulation and low density, and are widely used in the fields of machinery, electronics, chemical industry, metallurgy and nuclear energy. The composites have been applied to a large number of key components in the fields of aerospace, aviation, and national defense. The molding of the preform is a prerequisite for preparing the carbon/carbon composites.

Needle punching is a common process used in the molding of the preform. Needle-punching technology allows for the introduction of in-face fibers from fiber composite layups such as unidirectional fabrics and non-woven fabrics in the thickness direction, creating a unique three-dimensional preform. The needle-punched preform overcomes shortcomings of the weak interlaminar properties of the two-dimensional fiber structure, and has a higher damage tolerance. In addition, needle punching is able to prepare a variety of large-sized and complex-shaped preforms, and has now occupied an important position in the carbon fiber preform molding process.

The shape of the preform in the prior art is mainly focused on structures such as round, crucible-like, barrel-shaped, ring-shaped, and conical structures, which are relatively easy to process.

However, with the escalating demands of the industry, there are requirements for some unconventional shapes of carbon/carbon (C/C) composite products, such as carbon/carbon sagger. Carbon/carbon sagger is cubic in shape and open on one side, it is a high temperature container made of carbon/carbon composite material processing with the properties of light weight, high strength, good resistance to thermal shock, high purity, and strong resistance to abrasion. At present, most of the producers make carbon/carbon sagger using a process of carbon/carbon plates spliced together, the use of the process of the existence of leakage of powder, structural strength is low, the mission of the life of the short and other shortcomings. For example, CN116947520A discloses a method of preparing a carbon/carbon sagger preform using a splicing method, with a technical solution of laminating the first opening box body composite piece, the second opening box body composite piece, and the third opening box body composite piece in any order on the surface of a rectangular mold to form an opening box body, demolding, and heating to harden to obtain a carbon/carbon sagger preform.

Therefore, there is a great necessity to prepare an integral carbon/carbon sagger preform. At this stage, the preparation of the overall square preform is mainly by manual needle punching, low efficiency and difficult to standardize the operation, resulting in product quality is difficult to guarantee. Existing needle-punching device is more applicable to the needle punching of preforms with rounded corners, which is not applicable to the preparation of preforms with non-rounded corners.

Therefore, how to efficiently and high-quality standardize the needle-punching preparation of an angular preform, such as a square, has become an urgent problem.

In response to the above problem, the present disclosure provides a right-angle needle-punching mechanism and a needle-punching device to solve the difficulty of not being able to efficiently needle punch the angular preform, such as a square, in the prior art.

SUMMARY

The present disclosure provides a right-angle needle-punching mechanism, the right-angle needle-punching mechanism being fixed on a main frame of a needle-punching device for performing needle punching on a right-angle part of a preform. The right-angle needle-punching mechanism includes a first right-angle needle-punching assembly and a second right-angle needle-punching assembly, a position adjusting assembly configured to drive the first right-angle needle-punching assembly and the second right-angle needle-punching assembly approach or move away from the preform, and an angle adjustment assembly configured to change a needle-punching angle between the first right-angle needle-punching assembly and the second right-angle needle-punching assembly, the angle adjustment assembly, the first right-angle needle-punching assembly, and the second right-angle needle-punching assembly are arranged on the position adjusting assembly, the first right-angle needle-punching assembly includes a first right-angle needle plate, the second right-angle needle-punching assembly includes a second right-angle needle plate, the first right-angle needle plate and the second right-angle needle plate perform needle punching on respective side of the right-angle part of the preform. The main frame includes a first door-shaped frame and a second door-shaped frame, the first door-shaped frame and the second door-shaped frame being arranged opposite to each other; the position adjusting assembly includes two right-angle sliding plates located between the first door-shaped frame and the second door-shaped frame, a connecting plate fixedly connecting the two right-angle sliding plates, and a right-angle adjustment cylinder fixedly attached to an outer surface of at least one of the first door-shaped frame and the second door-shaped frame, the right-angle adjustment cylinder is connected to the connecting plate to drive the two right-angle sliding plates to move along a right-angle sliding rail arranged on inner surfaces of the first door-shaped frame and the second door-shaped frame. The angle adjustment assembly includes a driving member and an adjustment member, the first right-angle needle-punching assembly further includes a first right-angle cylinder and a first right-angle push rod connected to the first right-angle cylinder and the first right-angle needle plate, respectively, and the second right-angle needle-punching assembly further includes a second right-angle cylinder and a second right-angle push rod connected to the second right-angle cylinder and the second right-angle needle plate, respectively, the first right-angle cylinder and the second right-angle cylinder are connected to the adjustment member, respectively, and the driving member drives the adjustment member to adjust an angle between the first right-angle cylinder and the second right-angle cylinder.

Embodiments of the present disclosure also provide a needle punching device, including a base and a main frame fixed to the base. The main frame is provided with an upper needle-punching mechanism for performing needle punching on an upper surface of a preform, a lateral needle-punching mechanism for performing needle punching on a side surface of the preform, and the right-angle needle-punching mechanism as claimed above for performing the needle punching on the right-angle part of the preform.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering denotes the same structure, wherein.

Figure 1:
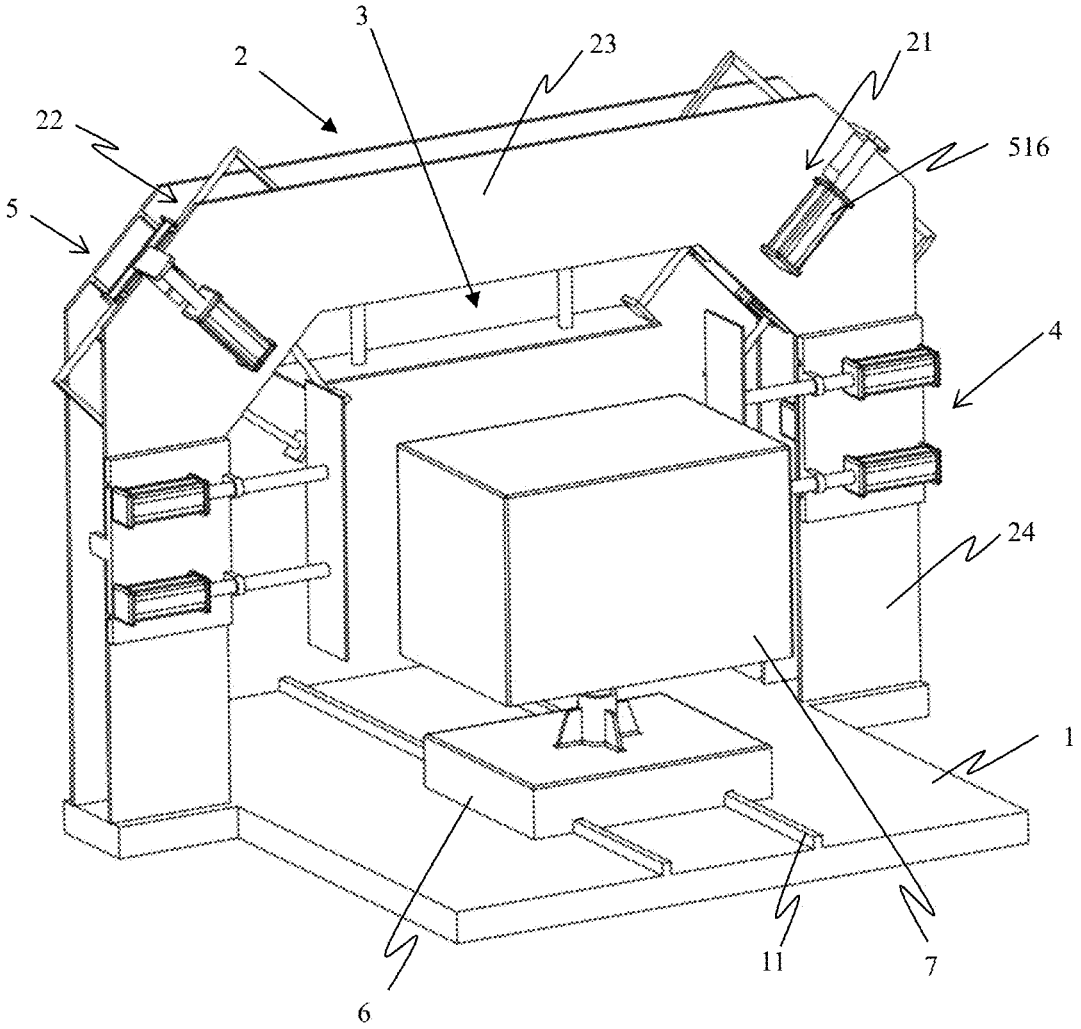
FIG. 1 is a schematic diagram illustrating an exemplary position of a right-angle needle-punching mechanism in a needle-punching device according to some embodiments of the present disclosure.

Description of the accompanying markings: 1, base; 11, moving guide rail; 2, main frame; 21, first door-shaped frame; 211, right-angle avoidance opening; 212, lateral avoidance opening; 22, second door-shaped frame; 23, crossbeam; 24, vertical brace; 25, right-angle sliding rail; 26, lateral slide; 3, upper needle-punching mechanism; 31, first upper cylinder; 32, second upper cylinder; 33, first upper push rod; 34, second upper push rod; 35, upper needle plate; 4, lateral needle-punching mechanism; 41, first lateral cylinder; 42, second lateral cylinder; 43, first lateral push rod; 44, second lateral push rod; 45, lateral needle plate; 46, lateral adjustment cylinder; 47, lateral sliding plate; 471, lateral sliding groove; 48, lateral connecting plate; 49, guide member; 5, right-angle needle-punching mechanism; 51, position adjusting assembly; 511, right-angle sliding plate; 512, connecting plate; 513, support rail; 514, right-angle sliding groove; 515, cylinder push plate; 516, right-angle adjustment cylinder; 52, angle adjustment assembly; 521, driving member; 5211, first bi-directional driving cylinder; 5212, second bi-directional driving cylinder; 5213, first driving rod; 5214, second driving rod; 522, adjustment member; 5221, moving rod; 5222, first pull rod; 5223, second pull rod; 5224, support block; 5225, first U-shaped plate member; 5226, second U-shaped plate member; 5227, movable plate; 5228, push rod; 5229, sliding slot; 53, first right-angle needle-punching assembly; 531, first right-angle cylinder; 532, first right-angle push rod; 533, first right-angle needle plate; 54, second right-angle needle-punching assembly; 541, second right-angle cylinder; 542, second right-angle push rod; 543, second right-angle needle plate; 6, moving platform; 61, platform body; 611, guide groove; 62, rotating shaft; 63, tray; 7, needle-punching mold.

DETAILED DESCRIPTION

In order to more clearly illustrate the technical solutions of the embodiments of the present disclosure, the accompanying drawings required to be used in the description of the embodiments are briefly described below. Obviously, the accompanying drawings in the following description are only some examples or embodiments of the present disclosure, and it is possible for a person of ordinary skill in the art to apply the present disclosure to other similar scenarios according to these drawings without creative labor. The present disclosure may be applied to other similar scenarios based on these drawings without creative labor. Unless obviously obtained from the context or the context illustrates otherwise, the same numeral in the drawings refers to the same structure or operation.

The following detailed description is made in conjunction with specific embodiments and the attached FIGS. 1-10, so as to enable the person skilled in the art to more fully understand the purpose, features and effects of the present application.

Unless otherwise limited, all technical and scientific terms used in the present disclosure have the same meaning as is commonly understood by those skilled in the art to which the present disclosure pertains. When there is a contradiction between the definitions of terms in the present disclosure and the meanings commonly understood by those skilled in the art, the definitions stated in the present disclosure shall prevail.

The present disclosure, by providing a right-angle needle-punching mechanism and a needle-punching device, performs efficient and high-quality standardized needle punching on a right-angle part of an angled carbon/carbon composite preform such as a square, in particular at a bottom corner part of the preform, to obtain a preform that meets the requirements.

Embodiment I

Figure 2:
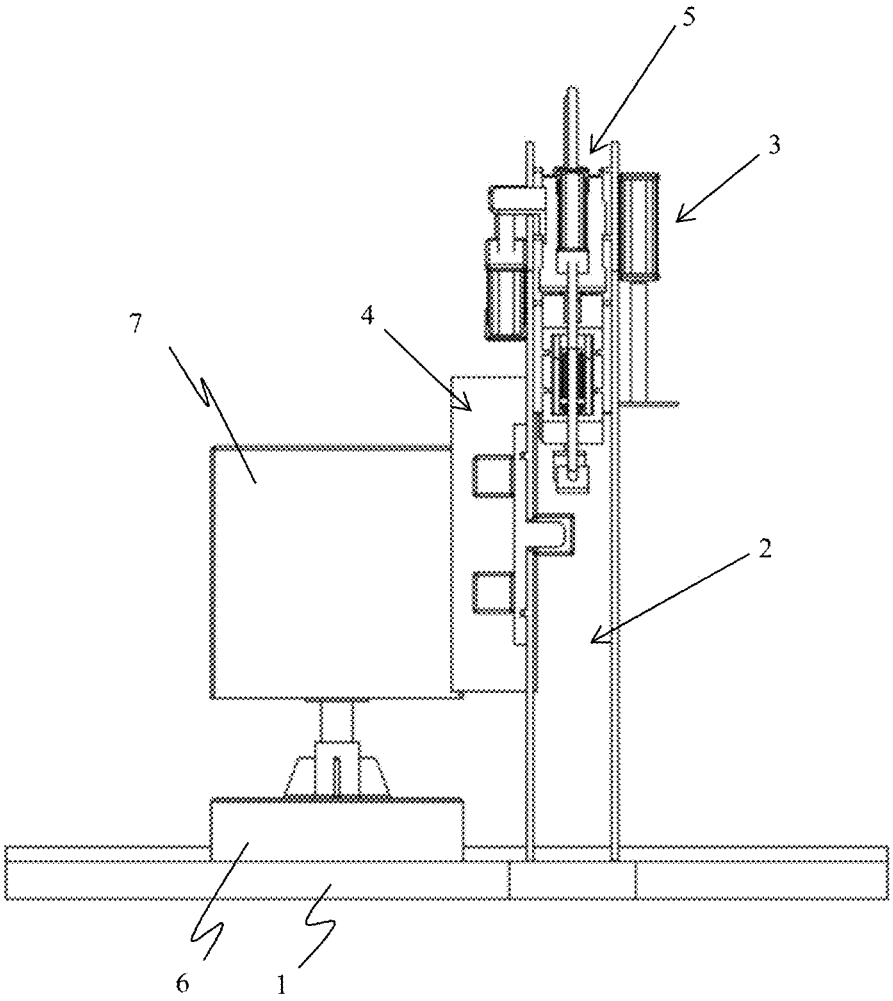
FIG. 2 is a side view illustrating an exemplary needle-punching device according to some embodiments of the present disclosure.

FIG. 1 is a schematic diagram illustrating an exemplary position of a right-angle needle-punching mechanism in a needle-punching device according to some embodiments of the present disclosure. FIG. 2 is a side view illustrating an exemplary needle-punching device according to some embodiments of the present disclosure.

As a specific embodiment of the present disclosure, the present embodiment provides a right-angle needle-punching mechanism, which is illustrated as an example of needle-punching molding of a square carbon/carbon sagger preform.

In some embodiments, with reference to FIGS. 1-2, a right-angle needle-punching mechanism is fixed to a main frame 2 of the needle-punching device, and needle punches a right-angle part of a preform. More descriptions regarding the needle-punching device may be found in related descriptions of Embodiment II.

The main frame 2 refers to a structure for securing and supporting remaining members of the needle-punching device. In some embodiments, the main frame 2 is provided with an upper needle-punching mechanism 3, a lateral needle-punching mechanism 4, a right-angle needle-punching mechanism 5, a needle-punching mold 7, and a moving platform 6 for placing the needle-punching mold 7.

The needle-punching mold 7 refers to a mold for fixing raw material of the preform, and specifications of the needle-punching mold 7 may be determined according to specifications of the preform to be made. In some embodiments, the needle-punching mold 7 may be in the shape of a cube, as shown in FIG. 1 and FIG. 2. More descriptions regarding the upper needle-punching mechanism 3, the lateral needle-punching mechanism 4 may be found in the relevant descriptions of Embodiments II. More descriptions regarding the right-angle needle-punching mechanism 5 may be found in FIGS. 3-7 and related descriptions thereof. More descriptions regarding the moving platform 6 may be found in FIG. 10 and related descriptions thereof.

Figure 3:
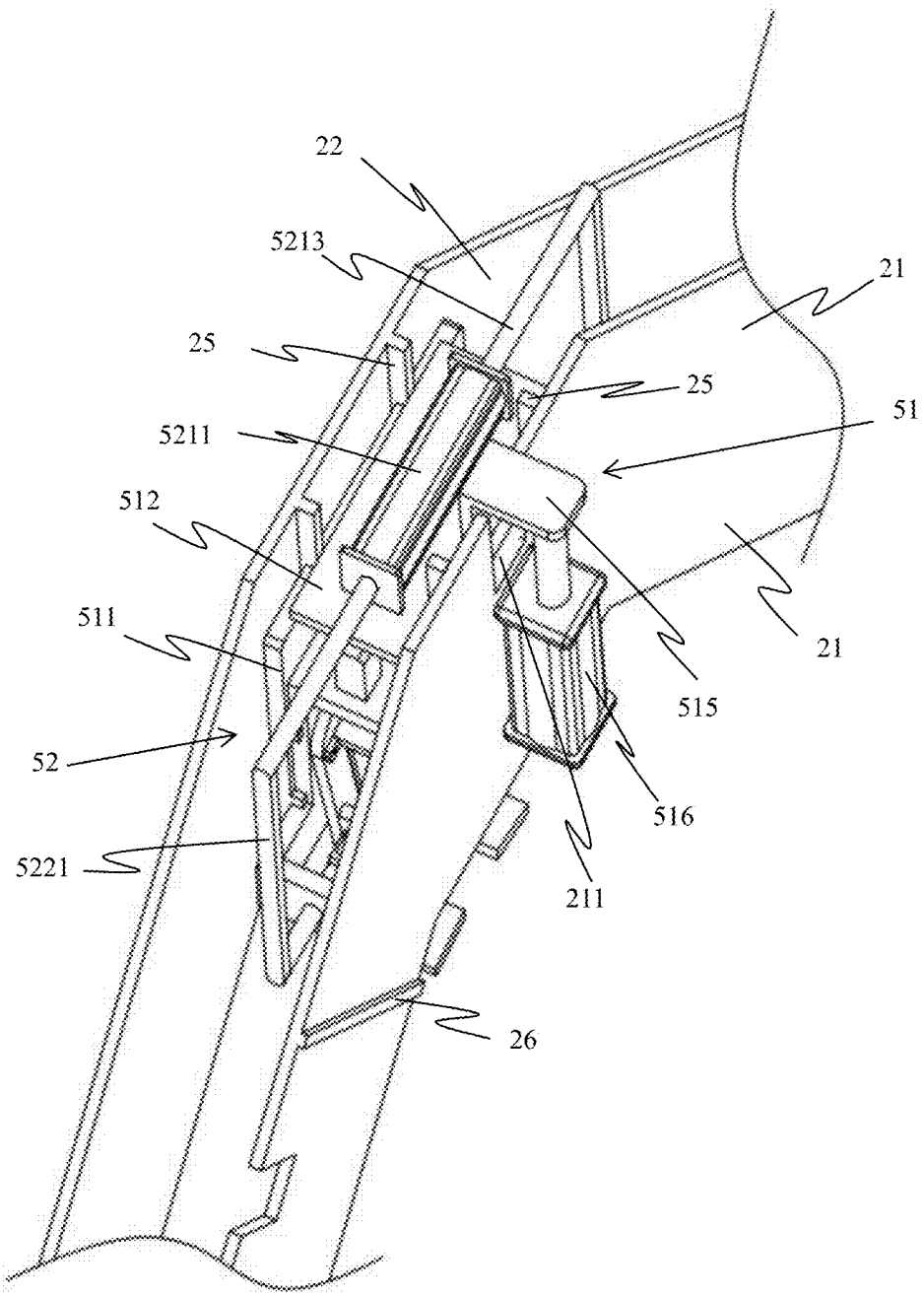
FIG. 3 is a schematic diagram illustrating an exemplary structure of a right-angle needle-punching mechanism according to some embodiments of the present disclosure.
Figure 4:
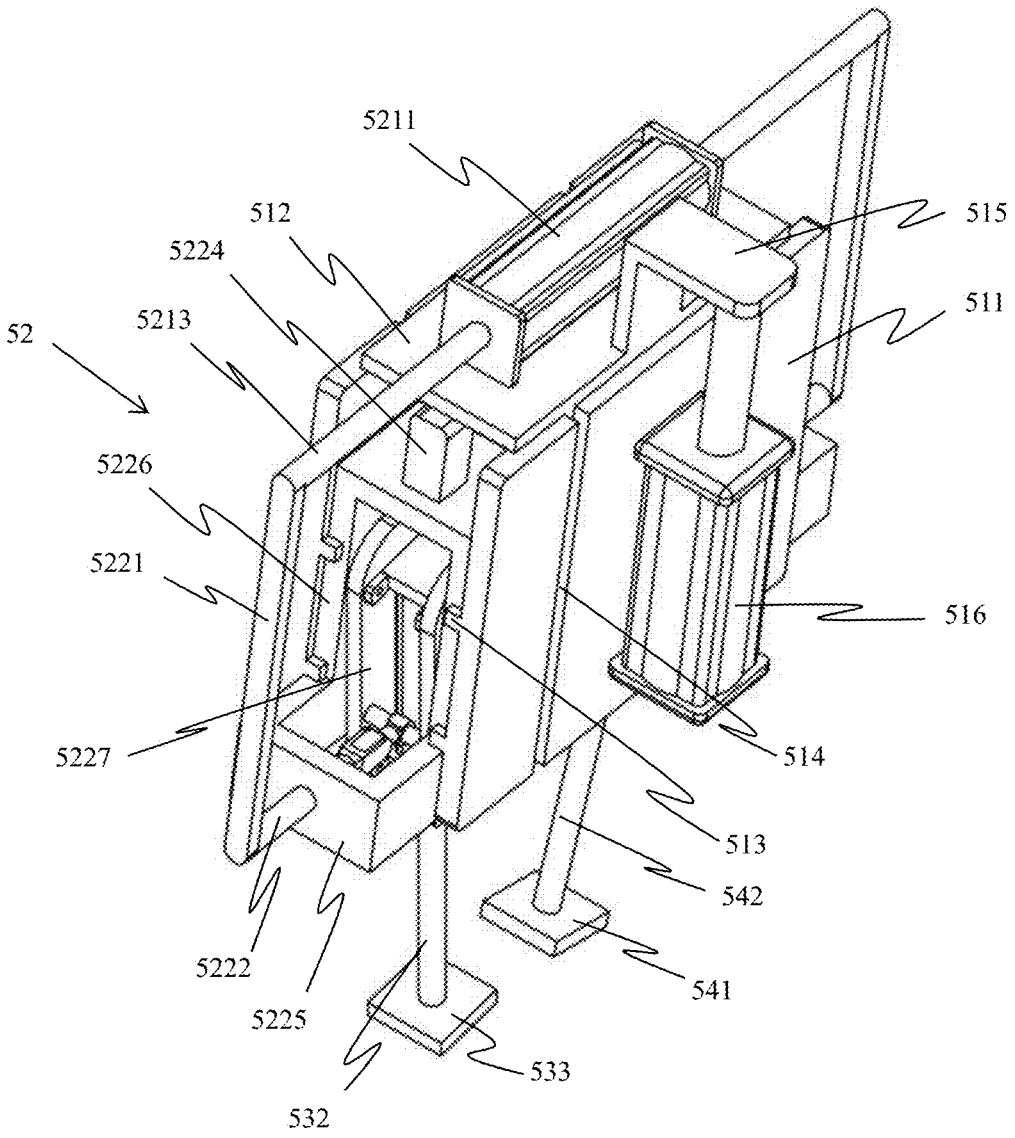
FIG. 4 is a schematic diagram illustrating an exemplary overall structure of a right-angle needle-punching mechanism according to some embodiments of the present disclosure.
Figure 5:
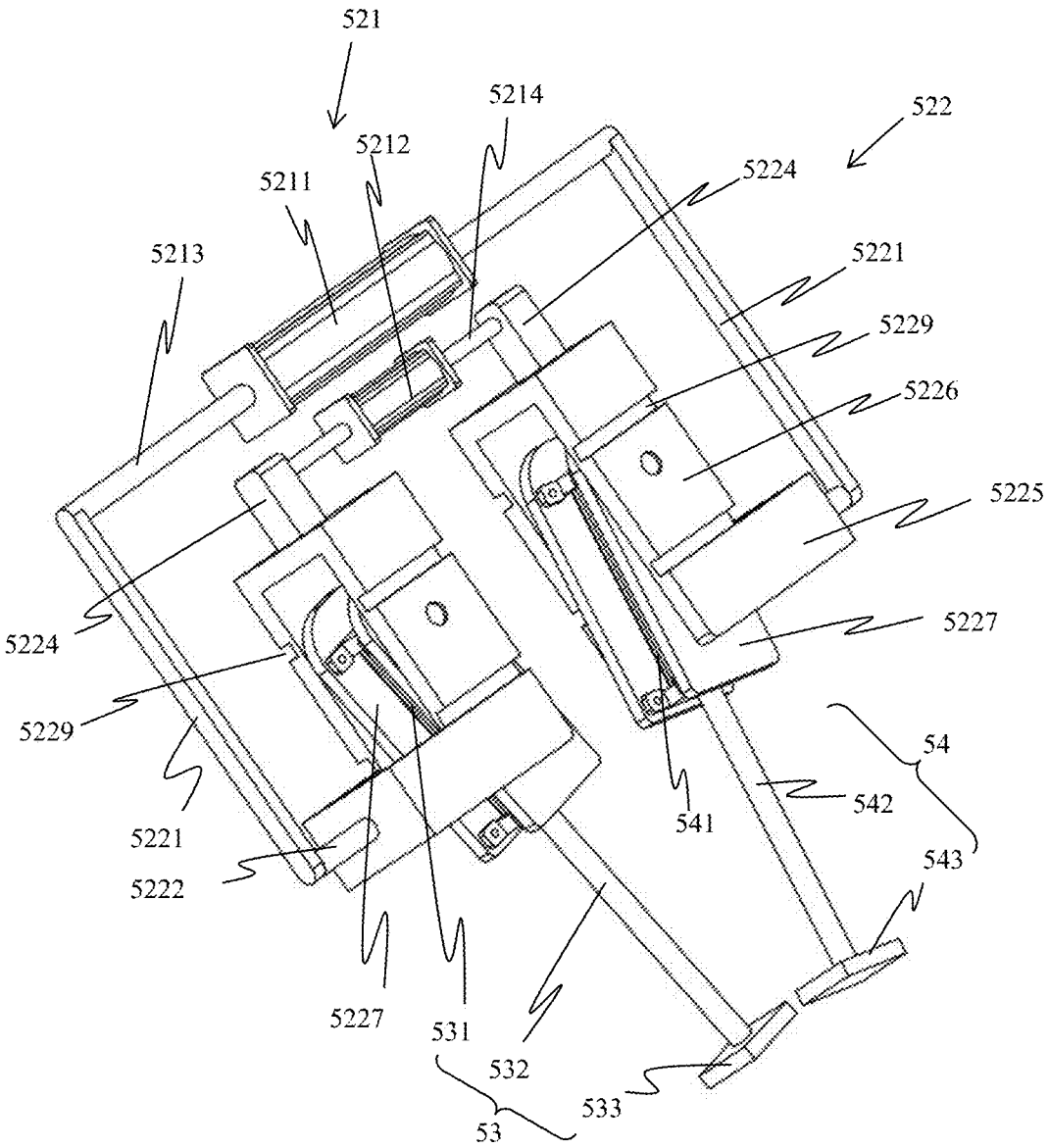
FIG. 5 is a schematic diagram illustrating an exemplary internal structure of a right-angle needle-punching mechanism according to some embodiments of the present disclosure.

FIG. 3 is a schematic diagram illustrating an exemplary structure of a right-angle needle-punching mechanism according to some embodiments of the present disclosure; FIG. 4 is a schematic diagram illustrating an exemplary overall structure of a right-angle needle-punching mechanism according to some embodiments of the present disclosure; FIG. 5 is a schematic diagram illustrating an exemplary internal structure of a right-angle needle-punching mechanism according to some embodiments of the present disclosure.

The embodiments of the present disclosure are illustrated by an embodiment of the right-angle needle-punching mechanism 5 located at an upper left corner of the main frame 2. In some embodiments, the right-angle needle-punching mechanism 5 includes a first right-angle needle-punching assembly 53 and a second right-angle needle-punching assembly 54, a position adjusting assembly 51 that drives the first right-angle needle-punching assembly 53 and the second right-angle needle-punching assembly 54 approach or move away from a position adjusting assembly 51 of the preform, and an angle adjustment assembly 52 that changes needle-punching angles of the first right-angle needle-punching assembly 53 and the second right-angle needle-punching assembly 54. The needling angle refers to an angle between a direction of motion of the right-angle needle-punching assembly and a surface of the preform when it is needle punching.

The position adjusting assembly 51 refers to an assembly for adjusting a position of a right-angle needle-punching assembly. In some embodiments, the angle adjustment assembly 52, the first right-angle needle-punching assembly 53, and the second right-angle needle-punching assembly 54 are disposed on the position adjusting assembly 51.

In some embodiments, the position adjusting assembly 51 drives the first right-angle needle-punching assembly 53 and the second right-angle needle-punching assembly 54 obliquely movable to approach or move away from needle punching the right-angle part of the needle-punching mold 7 so that the first right-angle needle-punching assembly 53 and the second right-angle needle-punching assembly 54 simultaneously perform needle punching on the right-angle part of the preform. For example, according to FIG. 1, the first right-angle needle-punching assembly 53 needles a right-angle part of the preform adjacent to a side, and the second right-angle needle-punching assembly 54 needles a right-angle part of the preform adjacent to an upper surface.

According to FIG. 1 and FIG. 5, when the right-angle needle-punching mechanism 5 is disposed in the upper right corner of the main frame 2, as the right-angle needle-punching mechanism 5 is inclined to the lower left corner, at this time the upper and lower relationships of the first right-angle needle-punching assembly 53 and the second right-angle needle-punching assembly 54 are made to be reversed, the first right-angle needle-punching assembly 53 needles the position of the right-angle part of the preform adjacent to the upper surface, and the second right-angle needle-punching assembly 54 needle punches the position of the right-angle part of the preform adjacent to the side.

In some embodiments, the first right-angle needle-punching assembly 53 includes a first right-angle needle plate 533, and the second right-angle needle-punching assembly 54 includes a second right-angle needle plate 543, the first right-angle needle plate 533 and the second right-angle needle plate 543 perform needle punching on one side of the right-angle part of the preform, respectively. More descriptions regarding to the positions where the first right-angle needle plate 533 and the second right-angle needle plate 54 perform needle punching may be found in the previous descriptions.

It should be noted that, for existing devices, there is generally only an upper needle-punching assembly and a lateral needle-punching assembly, and the assemblies are unable to simultaneously perform the needle punching at the right-angle part, and even if an R-angle needle-punching mechanism is introduced, since the R-angle needle-punching mechanism can only perform unidirectional needling, it may result in the collapse of the right-angle part without support, and the quality of the needling of the right-angle part cannot be guaranteed, whereas in the present disclosure, the first right-angle needle-punching assembly and the second right-angle needle-punching assembly can needle the two sides of the right-angle at the same time, and can form a mutual support for the side corners of the preform when needle punching, so as to ensure that the right-angle location has a regular shape, a uniform density, and a strength that meets the standard, and the situation of the collapse of a side of the right-angle part is avoided when the needle punching is performed separately.

In some embodiments, the main frame 2 includes a first door-shaped frame 21 and a second door-shaped frame 22, and the first door-shaped frame and the second door-shaped frame may be disposed opposite each other. For example, the first door-shaped frame 21 and the second door-shaped frame 22 may be disposed relative to each other spaced apart by a certain gap so that the needle-punching mechanism may be secured within the gap.

The first door-shaped frame 21 and the second door-shaped frame 22 are frames for securing the needle-punching mechanism. In some embodiments, both the first door-shaped frame 21 and the second door-shaped frame 22 include a crossbeam 23 and a vertical brace 24. In some embodiments, the crossbeam 23 and the vertical brace 24 are both in a plate-like shape. In some embodiments, each end of the crossbeam 23 is fixedly connected to one end of the vertical braces 24 on each side, and the bottom end of the vertical braces 24 is fixedly connected to the base 1.

In some embodiments, the upper needle-punching mechanism 3 is disposed on the crossbeam 23 for performing the needle punching on an upper surface of the preform, the lateral needle-punching mechanism 4 is disposed on the vertical brace 24 for performing the needle punching on a side surface of the preform, and the right-angle needle-punching mechanism 5 is obliquely disposed at a connection between the crossbeam 23 and the vertical brace 24 for performing the needle punching on a position within the right-angle part of the connection between the upper surface and the side of the square carbon/carbon sagger preform. For example, as shown in conjunction with FIGS. 1-3, the upper needle-punching mechanism 3, the lateral needle-punching mechanism 4, and the right-angle needle-punching mechanism 5 are disposed between the first door-shaped frame 21 and the second door-shaped frame 22.

In some embodiments, the position adjusting assembly 51 includes two right-angle sliding plates 511 disposed between the first door-shaped frame 21 and the second door-shaped frame 22, a connecting plate 512 configured to fixedly connect the two right-angle sliding plates 511, and a right-angle adjustment cylinder 516 fixed to an outer surface of at least one of the first door-shaped frame 21 and the second door-shaped frame 22. In some embodiments, the right-angle sliding plates 511 may be disposed at an inclined angle, and the two opposing right-angle sliding plates 511 are disposed at an inclined angle between the first door-shaped frame 21 and the second door-shaped frame 22, with the tops are fixedly connected utilizing a connecting plate 512.

In some embodiments, the position adjusting assembly 51 further includes a cylinder push plate 515. The cylinder push plate 515 refers to a plate for driving the connecting plate 512 to adjust the position of the right-angle needle-punching mechanism 5. In some embodiments, the cylinder push plate 515 is an angle plate, one end of which is fixedly connected to the connecting plate 512, and another end of which is fixedly connected to a piston rod of the right-angle adjustment cylinder 516.

The right-angle sliding rail 25 refers to a sliding rail for supporting the right-angle sliding plate 511 and allowing the right-angle sliding plate 511 to slide. In some embodiments, the right-angle sliding rail 25 is fixed to opposing surfaces of the first door-shaped frame 21 and the second door-shaped frame 22, the right-angle sliding rail 25 is parallel to the direction of expansion and contraction of the piston rod of the right-angle adjustment cylinder 516. In some embodiments, as shown in FIG. 3, two right-angle sliding rails 25 are arranged on the inner face of the first door-shaped frame 21 at intervals, and two right-angle sliding rails 25 are arranged on the corresponding position on the inner face of the second door-shaped frame 22 at intervals. In some embodiments, right-angle sliding grooves 514 are provided on two opposing right-angle sliding plates 511 on opposing sides to cooperate with the right-angle sliding rails 25, respectively.

The right-angle adjustment cylinder 516 refers to a cylinder used to drive the right-angle sliding plate 511 so as to adjust the position of the right-angle needle-punching mechanism 5. In some embodiments, the right-angle adjustment cylinder 516 is coupled to a connecting plate 512 and drives the two right-angle sliding plates 511 moving along the right-angle sliding rails 25 disposed on inner surfaces of the first door-shaped frame 21 and the second door-shaped frame 22.

For example, the right-angle adjustment cylinder 516 may be connected to the connecting plate 512 via the piston rod and the cylinder push plate 515, and when the piston rod of the right-angle adjustment cylinder 516 extends outwardly, which drives the lateral sliding plate 47 to slide diagonally upwardly along the right-angle sliding rail 25, thereby keeping the first right-angle needle-punching assembly 53 and the second right-angle needle-punching assembly 54 connected to the position adjusting assembly 51 away from the right-angle part of the preform or the needle-punching mold 7. When the piston rod of the right-angle adjustment cylinder 516 recovers, it drives the lateral sliding plate 47 to slide diagonally downwardly along the right-angle sliding rail, thereby causing the first right-angle needle-punching assembly 53 and the second right-angle needle-punching assembly 54 connected to the position adjusting assembly 51 to approach the right-angle part of the preform or the needle-punching mold 7.

In some embodiments, the right-angle adjustment cylinder 516 is fixed to and angled on a side of the first door-shaped frame 21 away from the second door-shaped frame 22, and the right-angle adjustment cylinder 516 is perpendicular to the connecting plate 512. The piston rod of the right-angle adjustment cylinder 516 extends diagonally upward. In some embodiments, the right-angle adjustment cylinder 516 may also be fixed to a side of the second door-shaped frame 22 away from the first door-shaped frame 21 and set at an angle. In some embodiments, the right-angle adjustment cylinder 516 may also be provided on both the first door-shaped frame 21 and the second door-shaped frame 22.

By setting the angle adjustment assembly 52, the distance between the first right-angle needle-punching assembly 53 and the second right-angle needle-punching assembly 54 can be adjusted, and a relative angle between the first right-angle needle-punching assembly 53 and the second right-angle needle-punching assembly 54 can also be adjusted.

By setting the position adjusting assembly 51, the distance between the first right-angle needle-punching assembly 53 and the second right-angle needle-punching assembly 54 and the preform 54 can be adjusted more flexibly, so that the right-angle needle punching can be better adapted to a variety of specifications or sizes of preforms.

In some embodiments, a right-angle avoidance opening 211 is also provided in the first door-shaped frame 21 that allows the cylinder push plate 515 to pass through. The right-angle avoidance opening 211 can form a guiding effect on the cylinder push plate 515, thereby improving the overall stability of the right-angle needle-punching mechanism 5.

In some embodiments, with reference to FIG. 4 and FIG. 5, the angle adjustment assembly 52 includes a driving member 521 and an adjustment member 522. The driving member 521 refers to a member for driving the adjustment member 522 for angle adjustment. For example, the driving member may be a cylinder, a motor, or the like. The adjustment member 522 refers to a member for adjusting the angle between the first right-angle cylinder 531 and the second right-angle cylinder 541.

In some embodiments, the first right-angle needle-punching assembly 53 further includes a first right-angle cylinder 531 and a first right-angle push rod 532 connected to the first right-angle cylinder 531 and the first right-angle needle plate 533, respectively, and the second right-angle needle-punching assembly 54 further includes a second right-angle cylinder 541 and a second right-angle push rod 542 connected to the second right-angle cylinder 541 and the second right-angle needle plate 543, respectively.

The first right-angle cylinder 531 refers to a cylinder for driving the first right-angle needle plate 533 for needle punching. The second right-angle cylinder 541 refers to a cylinder for driving the second right-angle needle plate 543 for needle punching. The first right-angle push rod 532 and the second right-angle push rod 542 are push rods for driving the right-angle needle plate based on a force generated by the right-angle cylinder. For example, the first right-angle cylinder 531 may drive the first right-angle needle plate 533 through the first right-angle push rod 532 to needle punch a side of a right-angle part of the preform.

In some embodiments, as shown in FIG. 5, a first right-angle needle plate 533 is fixedly connected to an end of a first right-angle push rod 532 away from a first right-angle cylinder 531; a second right-angle needle plate 543 is fixedly connected to a second right-angle push rod 542 away from the second right-angle cylinder 541.

In some embodiments, the first right-angle cylinder 531 and the second right-angle cylinder 541 are connected to the adjustment member 522, respectively, and the driving member 521 drives the adjustment member 522 to adjust an angle between the first right-angle cylinder 531 and the second right-angle cylinder 541. For example, the driving member 521 may drive the adjustment member 522 by a driving cylinder to drive the first right-angle cylinder 531 and the second right-angle cylinder 541 connected to the adjustment member 522 to move to realize the angle adjustment. More specific descriptions regarding adjusting the angle may be found below.

In some embodiments, as shown in FIGS. 4-5, the driving member 521 includes a first bi-directional driving cylinder 5211 fixed to the top surface of the connecting plate 512 and a second bi-directional driving cylinder 5212 fixed to the bottom surface of the connecting plate 512. The both ends of the first bi-directional driving cylinder 5211 are connected to a first driving rod 5213, respectively, and the both ends of the second bi-directional driving cylinder 5212 are connected to a second driving rod 5214.

The first bi-directional driving cylinder 5211 refers to a driving cylinder for driving the first driving rods 5213 on both sides. The second bi-directional driving cylinder 5212 refers to a driving cylinder for driving the second driving rods 5214 on both sides.

In some embodiments, one end of the first driving rod 5213 away from the first bi-directional driving cylinder 5211 is connected to the adjustment member 522, one end of the second driving rod 5214 away from the second bi-directional driving cylinder 5212 is connected to the adjustment member 522, and the first bi-directional driving cylinder 5211 and the second bi-directional driving cylinder 5212 synergistically drive the adjustment member 522 to adjust the angle between the first right-angle cylinder 531 and the second right-angle cylinder 541.

In some embodiments, the first bi-directional driving cylinder 5211 may drive the first driving rod 5213 and the second bi-directional driving cylinder 5212 may drive the second driving rod 5214, which in turn may drive the adjustment member 522 to adjust the angle between the first right-angle cylinder 531 and the angle between the second right-angle cylinder 541.

Figure 6:
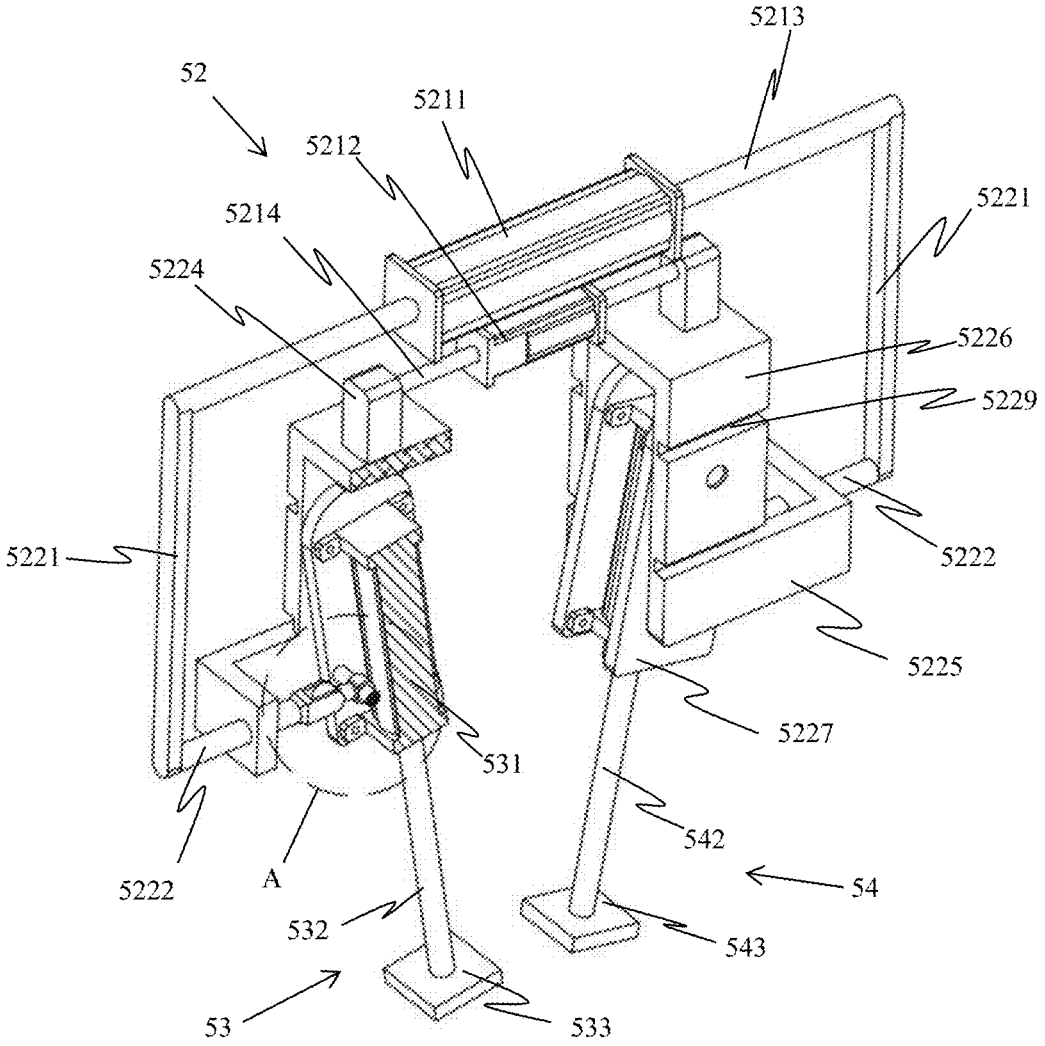
FIG. 6 is a partial cross-sectional view illustrating an exemplary right-angle needle-punching mechanism according to some embodiments of the present disclosure.
Figure 7:
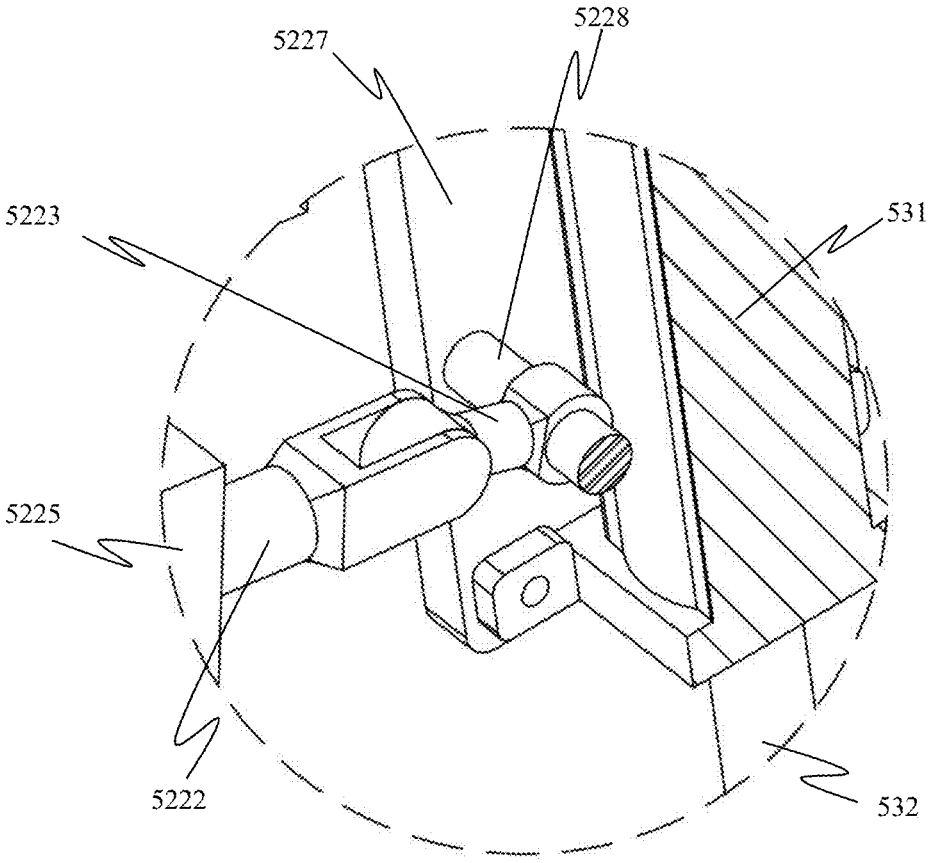
FIG. 7 is an exemplary partial enlargement of part A in FIG. 6.

FIG. 6 is a partial cross-sectional view illustrating an exemplary right-angle needle-punching mechanism according to some embodiments of the present disclosure, and FIG. 7 is an exemplary partially enlarged view of part A of FIG. 6.

In some embodiments, as shown in FIG. 6 and FIG. 7, the adjustment member 522 includes a moving rod 5221 coupled to the first driving rod 5213, a second driving rod 5214 coupled to the second driving rod 5224 with an opening back away from the first driving rod U-shaped plate member 5226, a first U-shaped plate member 5225 disposed between the moving rod 5221 and the second U-shaped plate member 5226 with the opening facing the second U-shaped plate member 5226, and two movable plates disposed within the second U-shaped plate member 5226.

The moving rod 5221 refers to a rod that transmits the driving rod to the first U-shaped plate member 5225. Exemplarily, the moving rod 5221 is fixed to an end of the first driving rod 5213 away from the first bi-directional driving cylinder 5211, and the moving rod 5221 may be two and perpendicular to the first driving rod 5213, with the second bi-directional driving cylinder 5212 is disposed between the two moving rods 5221. In some embodiments, a support block 5224 is fixedly connected to an end of the second driving rod 5214 away from the second bi-directional driving cylinder 5212, and the longitudinal axis of the support block 5224 is parallel to that of the moving rod 5221. A bottom end of the support block 5224 is fixedly connected to a second U-shaped plate member 5226 that is parallel to the moving rod 5221 and has a downward opening. The support block 5224 refers to a block for fixing and supporting the second U-shaped plate member 5226.

The first U-shaped plate member 5225 and the second U-shaped plate member 5226 are plates for assisting in adjusting the angle of the right-angle needle-punching assembly. In some embodiments, the first U-shaped plate member 5225 is disposed between a lower portion of the second U-shaped plate member 5226 and the moving rod 5221. In some embodiments, the first U-shaped plate member 5225 is disposed between the moving rod 5221 and the second U-shaped plate member 5226 and has an opening directed toward the second U-shaped plate member 5226 and perpendicular to the second U-shaped plate member 5226.

In some embodiments, the first U-shaped plate member 5225 is fixedly connected to the second U-shaped plate member 5226. Exemplarily, the first U-shaped plate member 5225 and the second U-shaped plate member 5226 may be molded in one piece. In some embodiments, the first U-shaped plate member 5225 and the second U-shaped plate member 5226 may be two sets symmetrically arranged.

The movable plate 5227 refers to a plate that adjusts the angle of the first right-angle cylinder 531 and the second right-angle cylinder 541 by rotation. In some embodiments, the two movable plates 5227 may be set relative to each other, as shown in FIG. 5. In some embodiments, the two movable plates 5227 are rotationally connected to the second U-shaped plate member 5226, and the first right-angle cylinder 531 and the second right-angle cylinder 541 are disposed between the two movable plates 5227, respectively, and in fixed connection with the two movable plates 5227 are fixedly connected. For example, the upper portion of the movable plate 5227 may be rotationally connected to the second U-shaped plate member 5226 by a connecting member (e.g., an articulating member, a bearing, etc.).

In some embodiments, as shown in FIGS. 6-7, the bottom end of the moving rod 5221 is fixedly connected to a first pull rod 5222 that is parallel to the first driving rod 5213 and passes through the bottom plate of the first U-shaped plate member 5225, one end of the first pull rod 5222 away from the moving rod 5221 is hinged to a second pull rod 5223 and one end of the second pull rod 5223 away from the first pull rod 5222 is rotationally connected to a push rod 5228, and both ends of the push rod 5228 along its longitudinal axis is fixedly connected to the two movable plates 5227, respectively. In some embodiments, the second U-shaped plate member 5226 may slide on the right-angle sliding plate 511 in a direction parallel to the first driving rod 5213. For example, the second U-shaped plate member 5226 may slide on the right-angle sliding plate 511 in a direction parallel to the first driving rod 5213 under a drive transmitted by the second driving rod 5214.

The first pull rod 5222 refers to a pull rod for driving the second pull rod 5223 to pull the movable plate 5227. In some embodiments, the second pull rod 5223 pulls the movable plate 5227 to rotate. The movable plate 5227 is not free to move due to the restriction of the second pull rod 5223 and the push rod 5228, which ensures the stability of the right-angle needle-punching assembly fixed to the movable plate 5227.

In some embodiments, under the action of the first bi-directional driving cylinder 5211 and the second bi-directional driving cylinder 5212, the first driving rod 5213 and the second driving rod 5214 drive the two opposing second U-shaped plate members 5226 approach or move away from each other, the adjustment of the distance between the two opposing second U-shaped plate members 5226 or the angle of the movable plate 5227 is realized, which in turn realizes the adjustment of the distance or angle between the first right-angle needle-punching assembly 53 and the second right-angle needle-punching assembly 54.

For example, in actual operation, when the strokes of the first bi-directional driving cylinder 5211 and the second bi-directional driving cylinder 5212 are the same, the first U-shaped plate member 5225 moves in synchronization with the first pull rod 5222, and the distance between the first right-angle needle plate 533 and the second right-angle needle plate 543 changes, while the angle between them does not change.

As another example, when the first bi-directional driving cylinder 5211 stops and the second bi-directional driving cylinder 5212 pushes the second U-shaped plate member 5226 to move outwardly, at this time, because the first pull rod 5222 does not move, relative motion occurs between the first pull rod 5222 and the first U-shaped plate member 5225, and the second pull rod 5223 drives the push rod 5228 to drive the movable plate 5227 to rotate, so that the angle of the lower part of the two movable plates 5227 become smaller, which in turn makes the angle between the first right-angle needle plate 533 and the second right-angle needle plate 543 become smaller, thereby realizing the adjustment of the angle (and at the same time the distance changes) between the first right-angle needle-punching assembly 53 and the second right-angle needle-punching assembly 54.

In some embodiments, as shown in FIG. 4, a sliding slot 5229 is provided on an outer surface of a side plate of the second U-shaped plate member 5226 parallel to the first driving rod 5213, and a support rail 513 that matches the sliding slot 5229 is provided on an inner surface of the right-angle sliding plate 511.

The sliding slot 5229 refers to a slot that allows the second U-shaped plate member 5226 to slide over the right-angle sliding plate 511 and provides support. The support rail 513 refers to a rail for cooperating with the sliding slot 5229 to provide support to and guide the sliding of the second U-shaped plate member 5226.

By providing a sliding slot and a support rail bar, the process of sliding the second U-shaped plate member 5226 in a direction parallel to the first driving rod 5213 can be made smoother to improve the smoothness of the second U-shaped plate member 5226, which in turn improves the right-angle needle-punching assembly's stability and ensures the needle punching quality.

The right-angle needle-punching mechanism of the present embodiment is designed for needle punching a square preform with a different shape from the preform in the prior art, and utilizes right-angle needle-punching plates of two relatively independent right-angle needle-punching assemblies to needle punch the right-angle part (i.e., positions of the upper surface and the side that near the right-angle) at the same time, to ensure that the needle-punching effect of the right-angle parts, and since the two sides of the needle-punching plate form a support for the preform at the same time as the needle punching, the collapsing of the parts which affecting the quality of needle punching is avoided.

Embodiment II

As another specific embodiment of the present disclosure, the present disclosure provides a needle-punching device including at least the right-angle needle-punching mechanism 5 of Embodiment I. The driving members in the present disclosure that reciprocally drive the needle plate to carry out the needle punching operation of the preform all use cylinders, and therefore, in the following descriptions, the direct drives of the needle plate are all cylinders, and the strokes as well as the operating states of all cylinders may be set and individually adjusted by a PLC program.

In some embodiments, as shown in FIGS. 1-2, the needle-punching device includes a base 1 and the main frame 2 secured to the base 1. The base 1 refers to a structure for supporting the main frame 2 and the remaining members of the needle-punching device. More descriptions regarding the main frame 2 may be found in the preceding descriptions of Embodiment I.

In some embodiments, the main frame 2 is provided with the upper needle-punching mechanism 3 for performing needle punching on an upper surface of the preform, the lateral needle-punching mechanism 4 for performing needle punching on a side surface of the preform, and the right-angle needle-punching mechanism 5 for performing needle punching on the right-angle part of the preform. More detailed description of the right-angle needle-punching mechanism 5 may be found in the relevant description of the preceding Embodiment I.

In some embodiments, the right-angle needle-punching mechanism 5 is symmetrically arranged on the main frame 2 to improve the efficiency of right-angle needle punching.

Referring to FIG. 1 and FIG. 2, the needle-punching device provided in this embodiment has the upper needle-punching mechanism 3, the lateral needle-punching mechanism 4, and the right-angle needle-punching mechanism 5 arranged in a staggered manner along the moving guide rail 11 of the base 1 so as not to form an operational interference with each other. The right-angle needle-punching mechanism 5 is located between the upper needle-punching mechanism 3 and the lateral needle-punching mechanism 4.

In some embodiments, the lateral needle-punching mechanism 4 may be symmetrically arranged on the main frame 2.

In some embodiments, in actual operation, the needle-punching mold 7 may first enter a needle-punching zone of the lateral needle-punching mechanism 4, followed by a needle-punching zone of the right-angle needle-punching mechanism 5, and then finally a needle-punching zone of the upper needle-punching mechanism 3. In some embodiments, since the preform has a certain volume, the three needle-punching mechanisms can operate simultaneously to improve the needle punching efficiency. The needle-punching zone refers to a zone where the needle-punching assembly is capable of needle punching.

Figure 9:
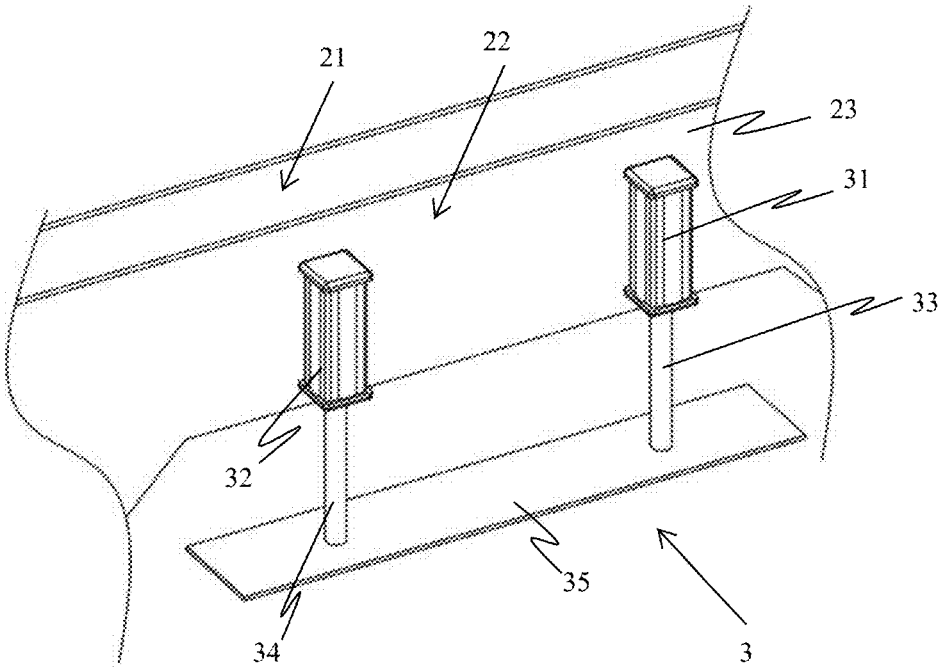
FIG. 9 is a schematic diagram illustrating an exemplary structure of an upper needle-punching mechanism according to some embodiments of the present disclosure.

FIG. 9 is a schematic diagram illustrating an exemplary structure of an upper needle-punching mechanism according to some embodiments of the present disclosure.

In some embodiments, with reference to FIG. 1 and FIG. 9, the upper needle-punching mechanism 3 includes at least one upper cylinder, at least one upper push rod, and an upper needle plate 35, with one end of the upper push rod along its longitudinal axis fixedly connected to the upper needle plate 35, and the other end fixedly connected to the upper cylinder, the upper cylinder driving the upper push rod to push the upper needle plate 35 downwardly near the needle-punching mold 7 or upwardly away from the needle-punching mold 7 to perform needle punching the upper surface of the preform.

In some embodiments, the upper needle-punching mechanism 3 includes a first upper cylinder 31 and a second upper cylinder 32 vertically disposed, and the first upper cylinder 31 and the second upper cylinder are both fixed to the side of the crossbeam 23 of the second door-shaped frame 22 dorsal to the first door-shaped frame 21, and the first upper air cylinder 31 and the second upper air cylinder 32 are symmetrically provided along the longitudinal axis of the crossbeam 23, so as to ensure that the upper needle plate 35 is subjected to a uniform force, so as to improve the quality of needle punching on the upper surface of the preform.

The first upper cylinder 31 simultaneously pushes the upper needle plate 35 in motion through the first upper push rod 33, and the second upper cylinder 32 pushes the upper needle plate 35 in motion through the second upper push rod 34, to perform the needle punching operation. It should be noted that the strokes of the first upper cylinder 31 and the second upper cylinder 32 are exactly the same, so as to keep the upper needle plate 35 in a horizontal state at all times, to form an effective needle punching on the upper surface of the preform, and to avoid the situation where needle punching in some areas is not properly performed.

Figure 8:
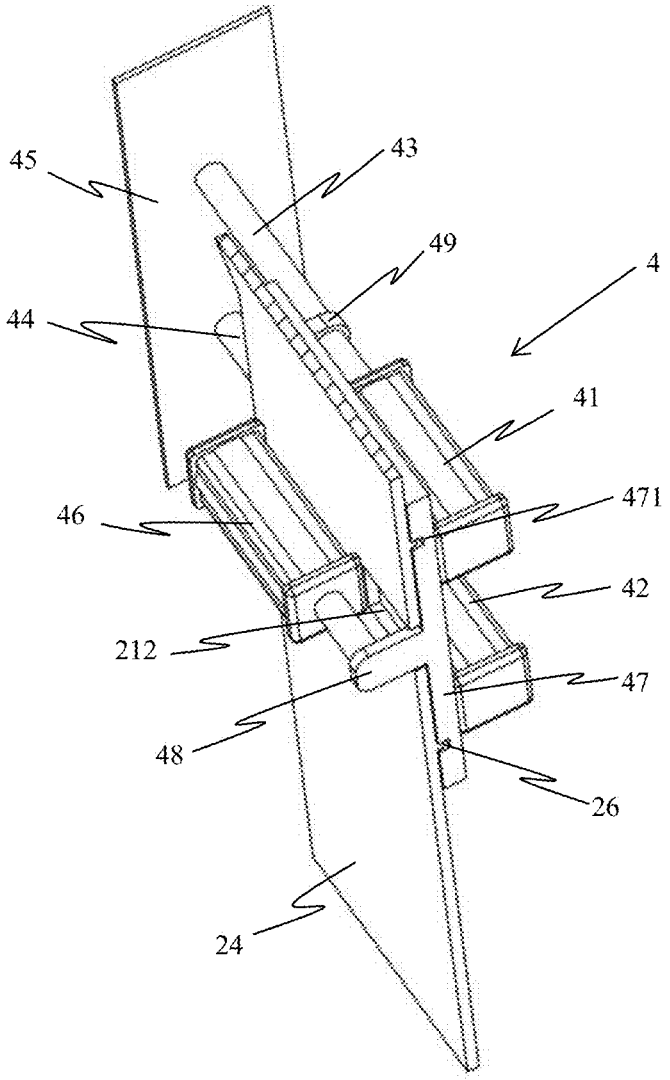
FIG. 8 is a schematic diagram illustrating an exemplary structure of a lateral needle-punching mechanism according to some embodiments of the present disclosure.

FIG. 8 is a schematic diagram illustrating an exemplary structure of a lateral needle-punching mechanism according to some embodiments of the present disclosure.

In some embodiments, with reference to FIG. 1 and FIG. 8, the lateral needle-punching mechanism 4 is disposed on vertical braces 24 of the first door-shaped frame 21 and is provided on both of the two vertical braces 24 of the first door-shaped frame 21 so as to be able to simultaneously needle punch on both sides of the preform on the needle-punching mold 7 located in the middle, improving the needle punching efficiency.

This embodiment is illustrated with one of two lateral needle-punching mechanisms 4. In some embodiments, the lateral needle-punching mechanism 4 includes at least one lateral cylinder horizontally disposed, at least one lateral push rod, and a lateral needle plate 45.

The lateral cylinder refers to a cylinder used to drive the lateral needle plate 45 for needle punching. The lateral push rod refers to a push rod used to connect the lateral needle plate 45 to the lateral cylinder.

In some embodiments, one end of the lateral push rod along its longitudinal axis is fixedly connected to the lateral needle plate 45, and the other end is connected to the lateral cylinder, and the lateral needle plate 45 is disposed vertically and directed toward the needle-punching mold 7. The lateral cylinder drives the lateral push rod to push the lateral needle plate 45 to reciprocate to complete the needle punching operation on the side surface of the preform.

In some embodiments, the lateral needle-punching mechanism 4 includes a first lateral cylinder 41 that is horizontally disposed and a second lateral cylinder 42, with the first lateral cylinder 41 and the second lateral cylinder 42 spaced apart at a top and bottom. In some embodiments, the first lateral cylinder 41 and the second lateral cylinder 42 are disposed on the side of the vertical brace 24 of the first door-shaped frame 21 that is backed to the second door-shaped frame 22. The first lateral cylinder 41 simultaneously moves the lateral needle plate 45 through the first lateral push rod 43 and the second lateral cylinder 42 through the second lateral push rod 44 to carry out a needle punching operation of the preform. It should be noted that the strokes of the first lateral cylinder 41 and the second lateral cylinder 42 are exactly the same, so that the lateral needle plate 45 is always in a vertical state, and the needle punching of the side surface of the preform is formed in a completely effective manner to avoid a situation where part of the area is not needle punched properly.

In some embodiments, the position of the lateral needle plate 45 needs to be adjusted in order to accommodate the needle punching of different sizes or dimensions of preforms. In some embodiments, instead of fixing the first lateral cylinder 41 and the second lateral cylinder 42 directly to the vertical brace 24 of the first door-shaped frame 21, the first lateral cylinder 41 and the second lateral cylinder 42 may be disposed to be horizontally adjustable.

Exemplarily, as shown in FIG. 8, the lateral needle-punching mechanism 4 further includes a lateral adjustment cylinder 46, a lateral sliding plate 47, and a lateral connecting plate 48. In some embodiments, the lateral cylinder is fixed to the lateral sliding plate 47. The lateral sliding plate 47 is used to drive the lateral needle plate 45 in a direction perpendicular to the side of the needle-punching mold 7. For example, both the first lateral cylinder 41 and the second lateral cylinder 42 are fixed to the lateral sliding plate 47. The lateral sliding plate 47 is disposed between the first lateral cylinder 41 and the vertical brace 24 of the first door-shaped frame 21 and fits snugly against the vertical brace 24.

In some embodiments, a lateral sliding rail 26 projecting outwardly is fixed horizontally at a side of the vertical brace 24 of the first door-shaped frame 21 toward the lateral sliding plate 47, and a lateral sliding groove 471 is provided in a side of the lateral sliding plate 47 toward the vertical brace of the first door-shaped frame 21 that cooperates with the lateral sliding rail 26. The lateral sliding plate 47 is capable of being moved along the lateral sliding rail 26 so as to drive the first lateral cylinder 41 and the second lateral cylinder 42 to move horizontally. On the other hand, the lateral sliding rail 26 also serves as a fixed support effect for the lateral sliding plate 47.

In some embodiments, the lateral sliding plate 47 is moved approach and move away from the needle-punching mold 7 under the action of a horizontally disposed lateral adjustment cylinder 46 fixed to the main frame 2. Exemplarily, the lateral adjustment cylinder 46 is fixed horizontally at a side of the vertical brace of the first door-shaped frame 21 dorsal to the lateral sliding plate 47, and a piston rod body of the lateral adjustment cylinder 46 extends in a direction of dorsal away from the lateral needle plate 45.

In some embodiments, the piston rod body of the lateral adjustment cylinder 46 and the lateral sliding plate 47 may be connected to one another utilizing a lateral connecting plate 48. When the piston rod body of the lateral adjustment cylinder 46 extends outwardly, it drives the lateral sliding plate 47 in a direction away from the needle-punching mold 7, and when the piston rod body of the lateral adjustment cylinder 46 recovers inwardly, it drives the lateral sliding plate 47 in a the direction near the needle-punching mold 7, thereby realizing the change of the positions of the first lateral cylinder 41 and the second lateral cylinder 42.

In some embodiments, the vertical brace 24 of the first door-shaped frame 21 is provided with a lateral avoidance opening 212 that permits the lateral connecting plate 48 to be movable, and the lateral connecting plate 48 moves along the lateral avoidance opening 212 when it is movable under the driving of the lateral adjustment cylinder 46, and the vertical brace 24 of the first door-shaped frame 21 plays a certain supporting role for the lateral connecting plate 48, thereby strengthening the solidity of the entire lateral needle-punching mechanism 4.

In some embodiments, a guide member 49 is provided between the first lateral cylinder 41 and the lateral needle plate 45, and between the second lateral cylinder 42 and the lateral needle plate 45, and the guide member 49 is fixed to the lateral sliding plate 47 with guide holes, and the first lateral push rod 43 and the second lateral push rod 44 pass through the guide holes. The guide member 49 has a guiding effect and a supporting effect on the first lateral push rod 43 and the second lateral push rod 44 to ensure that the lateral needle plate 45 connected to the first lateral push rod 43 and the second lateral push rod 44 is in a stable perpendicular to the side surface of the preform, avoiding tilting of the lateral needle plate 45 and avoiding the risk of bending of the first lateral push rod 43 and the second lateral push rod 44.

By setting up a multi-system and multi-dimensional needle plate, it solves the difficulty of low processing efficiency of the preform caused by the small number of effective working needle plates, reduces the time cost, and compared with the existing devices assembled with a single needle plate that can only realize one surface of the product each time, the use of the equipment can simultaneously process the three surfaces of the product (the upper surface and the two side surfaces) and the right-angle part of the product, which saves more than 70% of the processing time.

Figure 10:
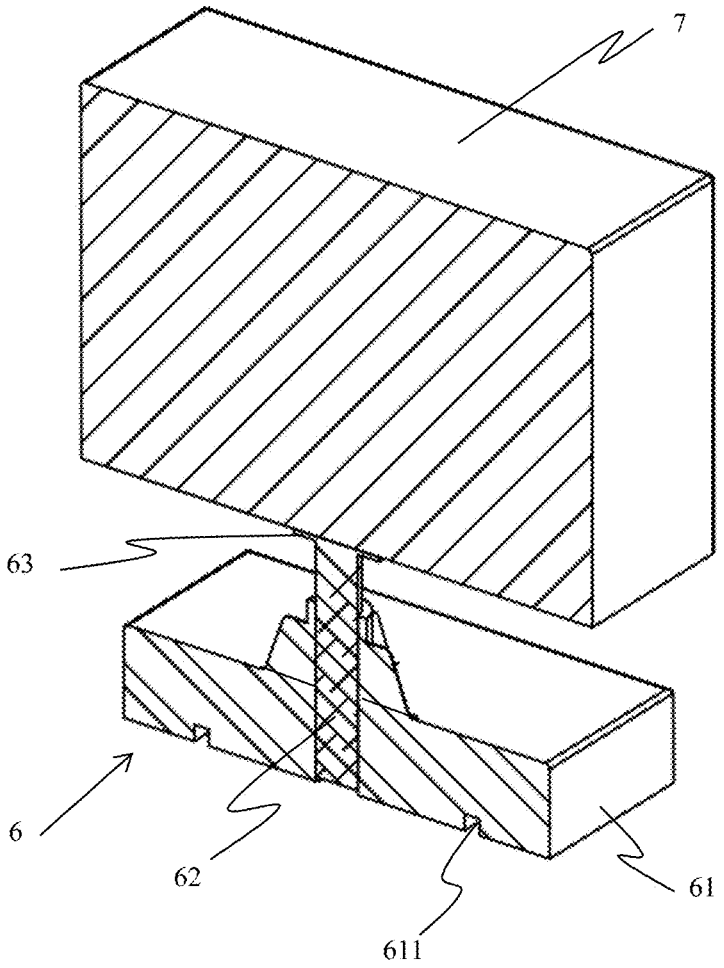
FIG. 10 is a cross-sectional view illustrating an exemplary moving platform according to some embodiments of the present disclosure.

FIG. 10 is a cross-sectional view illustrating an exemplary moving platform according to some embodiments of the present disclosure.

In some embodiments, with reference to FIG. 1 and FIG. 10, the needle-punching device further includes a moving platform 6 that supports and drives the needle-punching mold 7 in a movable manner, the moving platform 6 comprises a platform body 61. The platform body 61 refers to a main platform structure of the moving platform 6. In some embodiments, the platform body 61 is rectangular in shape. In some embodiments, a guide groove 611 is provided on a bottom surface of the platform body 61, and the guide groove 611 cooperates with a moving guide rail 11 provided on the base 1 so as to enable the platform body 61 to be moved along the moving guide rail 11, thereby adjusting a needle-punching position of the preform. In some embodiments, the number of the guide groove 611 is equal to the number of the moving guide rail 11.

By means of the cooperating the moving guide rail 11 and the guide groove 611, the platform body 61 can be pushed to move along the longitudinal axis of the moving guide rail 11, thereby adjusting a horizontal position of the needle-punching mold 7 disposed on the moving platform 6 so as to carry out different positions of the preform for the needle punching operation. In order to better move the platform body 61, a power mechanism may be utilized to push the platform body 61 to move along the moving guide rail 11, and the power mechanism may be adopted from the power mechanism already available in the prior art (e.g., a cylinder or a motor), which may not be repeated in this embodiment.

In some embodiments, the moving platform 6 further includes a rotation mechanism rotationally connected to the platform body 61. The rotation mechanism refers to a mechanism for driving the needle-punching mold 7 to rotate. For example, the rotation mechanism may be a rotating shaft 62, an upper portion of the rotating shaft 62 extends to the exterior of the platform body 61, a tray 63 is fixed at the top of the rotating shaft 62, the tray 63 is fixedly connected to the needle-punching mold 7, and the rotating shaft 62 and the tray 63 together support the needle-punching mold 7 in the upper portion. In some embodiments, the tray 63 and the needle-punching mold 7 may be bolted together, facilitating the replacement of different needle-punching molds 7, and the setting of the tray 63 also increases the support area of the needle-punching mold 7, making the needle-punching mold 7 more stable.

The rotation of the rotating shaft 62 may be motor-driven, and in some embodiments, the motor may be placed within the platform body 61. The rotation of the rotating shaft 62 by the motor is followed by the rotation of the needle-punching mold 7 to achieve needle punching operations on the different sides of the preform.

Alternatively, in order to make it possible to adjust the position of the needle-punching mold 7 in the vertical space for better needling, a lifting mechanism can be provided on the moving platform 6, and the lifting mechanism is used to lift and lower the needle-punching mold 7. By providing the lifting mechanism, the needle-punching mold 7 can be lifted and lowered while rotating the needle-punching mold 7, which enhances the flexibility of the needle-punching mold 7.

The lifting mechanism may be a pre-existing technical means in the prior art, for example, a folding lifting mechanism and platform as shown in the patent CN210505394U (not shown in the figure) is then installed on the tray 63, which may be adapted and improved to meet the requirements of the present embodiment when applied to the present embodiment. For example, the needle-punching mold 7 may be secured above the lifting mechanism, and the area of the tray 63 may be correspondingly enlarged to facilitate installation of the lifting mechanism. The lifting mechanism may also be other feasible mechanisms in the prior art, and this embodiment is not specifically limited.

In the process of use, the right-angle needle-punching mechanism 5 and the lifting and lowering needle-punching mold 7 may be adjusted so that one of the right-angle needle-punching plates of the right-angle needle-punching mechanism 5 is aligned with the side ribs on the top of the preform, and the side ribbed part is needled effectively to ensure the needling density, which is important for obtaining a high quality finished preform.

By setting the lateral needle plate which can adjust the position laterally and the moving platform which can be lifted up and down, it can not only be adapted to the needling of the square preform of different specifications or sizes, but also, for the preforms with other shapes, it can be adjusted accordingly according to the actual need to be applicable to.

This greatly improves the practicability and utilization rate of the equipment, and reduces the capital investment of infrastructure equipment.

Exemplarily, the needle-punching device works in the following specific operations:

1. Different needle-punching mold 7 is selected according to different specification shape of the preform, and the needle-punching mold 7 is fixed on the moving platform 6.
2. The unloaded needle-punching mold 7 is moved to the needle-punching area by the moving platform 6, and a needle-punching working interval is set according to the specification size of the preform and the pre-set needle-punching depth: the lateral sliding plate 47 is adjusted to set the side-direction needle-punching working interval, so that the needle-punching mold 7 is in a needle-punching range of the lateral needle plate 45; the moving platform 6 is lifted and moved to adjust the height-direction needle-punching working interval, so that the needle-punching mold 7 is within the needle-punching range of the upper needle plate 35; and the needle-punching mold 7 is adjusted to a position within the needle-punching range of the right-angle needle-punching plate through the cooperation of the position adjusting assembly 51 and the angle adjustment assembly 52.
3. The unloaded needle-punching mold 7 is moved out of the needle-punching area by means of the moving platform 6, and the raw materials (e.g., carbon cloth, non-woven fabrics, etc.) used for making the preform are laid and fixed on the needle-punching mold 7.
4. The needle-punching mold 7 with the material spread is moved into the needle-punching area, the needle-punching device is started to perform needle punching, and a multi-system and multi-dimensional needle punching operation on the preform is performed by means of the lateral needle plate 45, the upper needle plate 35, and the right-angle needle plate. The moving platform 6 is moved along the moving guide rail 11 during the needle punching process to realize automated continuous needle punching.
5. When a pair of sides and the upper surface of the preform are needled, the moving platform 6 is rotated to turn the preform to over so as to perform the needle punch on the remaining pair of sides, and the height of the moving platform 6 is lowered or the upper needle-punching mechanism 3 is shut down to spare the upper surface of the preform from being repeatedly needle punching; the preform is rotated and the lateral needle plate 45 is utilized to process the vertical right-angle sides of the preform.
6. The angle and position of the right-angle needle plate and the position of the preform is adjusted to perfect the needle punching process of the top right-angle edge (top edge rib).

The right-angle needle-punching mechanism and the needle-punching device of the present disclosure are applicable to the processing of square preforms, such as a sagger preform, and can be adjusted accordingly to be applicable to preforms of other shapes according to practical needs, for example, the right-angle needle-punching mechanism 5 can be applied to the processing of preforms with an obtuse angle at the connection of two sides to enhance the needle punching strength at the connection.

The right-angle needle-punching mechanism and the needle-punching device provided by embodiments of the present disclosure are provided with the right-angle needle-punching mechanism and the needle-punching device by providing the position adjusting assembly comprising the first right-angle needle-punching assembly and the second right-angle needle-punching assembly, the position adjusting assembly that drives the first right-angle needle-punching assembly and the second right-angle needle-punching assembly approach or move away from the preform, and the angle adjustment assembly to change the needle-punching angles of the first right-angle needle-punching assembly and the second right-angle needle-punching assembly, the right-angle needle-punching mechanism realizes effective needle punching of the right-angle part of the square preform, fills the gap of the device for efficiently making the square preform, and innovates the existing processes of making square preform. In addition, the embodiments of the present disclosure provide a high degree of automation of the needle-punching device, which not only can streamline operation to improve production efficiency and reduce labor costs, but also can control and design the processing volume, which can guarantee the production quality of the product and avoid manual needle punching quality, avoiding the problem of substandard quality caused by unstandardized operation of manual needle punching.

The basic concepts have been described above, and it is apparent to those skilled in the art that the foregoing detailed disclosure serves only as an example and does not constitute a limitation of the present disclosure. While not expressly stated herein, various modifications, improvements, and amendments may be made to the present disclosure by those skilled in the art. Those types of modifications, improvements, and amendments are suggested in the present disclosure, so those types of modifications, improvements, and amendments remain within the spirit and scope of the exemplary embodiments of the present disclosure.

Meanwhile, the present disclosure uses specific words to describe the embodiments of the present disclosure. For example, "one embodiment," "an embodiment," and/or "some embodiments" refer to a certain feature, structure or characteristic related to at least one embodiment of the present disclosure. Therefore, it should be emphasized and noted that references to "one embodiment" or "an embodiment" or "an alternative embodiment" two or more times in different places in the present disclosure do not necessarily refer to the same embodiment. In addition, certain features, structures or characteristics in one or more embodiments of the present disclosure may be properly combined.

While a number of embodiments presently considered useful are discussed in the foregoing disclosure by way of various examples, it is to be understood that such detail serves an illustrative purpose only, and that the additional claims are not limited to the disclosed embodiments, but rather, the claims are intended to cover all amendments and equivalent combinations that are consistent with the substance and scope of the embodiments of the present disclosure.

Similarly, it should be noted that in order to simplify the presentation of the disclosure of the present disclosure, and thereby aid in the understanding of one or more embodiments of the invention, the foregoing descriptions of embodiments of the specification sometimes group multiple features together in a single embodiment, accompanying drawings, or a description thereof. However, this method of disclosure does not imply that the objects of the present disclosure require more features than those mentioned in the claims.

For each patent, patent application, patent application disclosure, and other material cited in the present disclosure, such as articles, books, specification sheets, publications, documents, and the like, the entire contents of which are hereby incorporated herein by reference. Excluded are application history documents that are inconsistent with or create a conflict with the contents of the present disclosure, as well as documents that limit the broadest scope of the claims of the present disclosure. It should be noted that in the event of any inconsistency or conflict between the descriptions, definitions, and/or use of terminology in the materials appurtenant to the present disclosure and those set forth in the present disclosure, the descriptions, definitions and/or use of terminology in the present disclosure shall prevail.

In closing, it is to be understood that the embodiments of the present disclosure disclosed herein are illustrative of the principles of the embodiments of the present disclosure. Other modifications that may be employed may be within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. A right-angle needle-punching mechanism, the right-angle needle-punching mechanism being fixed on a main frame of a needle-punching device for performing needle punching on a right-angle part of a preform, wherein the right-angle needle-punching mechanism includes a first right-angle needle-punching assembly, a second right-angle needle-punching assembly, a position adjusting assembly configured to drive the first right-angle needle-punching assembly and the second right-angle needle-punching assembly to approach or move away from the preform, and an angle adjustment assembly configured to change needle-punching angles of the first right-angle needle-punching assembly and the second right-angle needle-punching assembly, the angle adjustment assembly, the first right-angle needle-punching assembly, and the second right-angle needle-punching assembly are arranged on the position adjusting assembly, the first right-angle needle-punching assembly includes a first right-angle needle plate, the second right-angle needle-punching assembly includes a second right-angle needle plate, the first right-angle needle plate and the second right-angle needle plate perform needle punching on respective sides of the right-angle part of the preform;

the main frame includes a first door-shaped frame and a second door-shaped frame, the first door-shaped frame and the second door-shaped frame being arranged opposite to each other; the position adjusting assembly including two right-angle sliding plates located between the first door-shaped frame and the second door-shaped frame, a connecting plate fixedly connecting the two right-angle sliding plates, and a right-angle adjustment cylinder fixedly attached to an outer surface of at least one of the first door-shaped frame and the second door-shaped frame, the right-angle adjustment cylinder being connected to the connecting plate to drive the two right-angle sliding plates to move along a right-angle sliding rail arranged on inner surfaces of the first door-shaped frame and the second door-shaped frame;

the angle adjustment assembly includes a driving member and an adjustment member, the first right-angle needle-punching assembly further including a first right-angle cylinder and a first right-angle push rod connected to the first right-angle cylinder and the first right-angle needle plate, respectively, and the second right-angle needle-punching assembly further including a second right-angle cylinder and a second right-angle push rod connected to the second right-angle cylinder and the second right-angle needle plate, respectively, the first right-angle cylinder and the second right-angle cylinder being connected to the adjustment member, respectively, and the driving member driving the adjustment member to adjust an angle between the first right-angle cylinder and the second right-angle cylinder.

2. The right-angle needle-punching mechanism according to claim 1, wherein the driving member includes a first bi-directional driving cylinder fixed to a top surface of the connecting plate and a second bi-directional driving cylinder fixed to a bottom surface of the connecting plate, both ends of the first bi-directional driving cylinder are connected to a first driving rod, respectively, both ends of the second bi-directional driving cylinder are connected to a second driving rod, respectively, one end of the first driving rod away from the first bi-directional driving cylinder is connected to the adjustment member, one end of the second driving rod away from the second bi-directional driving cylinder is connected to the adjustment member, and the first bi-directional driving cylinder and the second bi-directional driving cylinder synergistically drive the adjustment member to adjust the angle between the first right-angle cylinder and the second right-angle cylinder.

3. The right-angle needle-punching mechanism according to claim 2, wherein the adjustment member includes a moving rod coupled to the first driving rod, a second U-shaped plate member coupled to the second driving rod with its opening facing away from the first driving rod, a first U-shaped plate member located between the moving rod and the second U-shaped plate member with its opening facing the second U-shaped plate member, and two movable plates located in the second U-shaped plate member, the first U-shaped plate member is fixedly connected to the second U-shaped plate member, the two movable plates are rotationally connected to the second U-shaped plate member, the first right-angle cylinder and the second right-angle cylinder are located between the two movable plates and fixedly connected to the two movable plates, respectively, a bottom end of the moving rod is fixedly connected to a first pull rod which is parallel to the first driving rod and passes through a bottom plate of the first U-shaped plate member, one end of the first pull rod away from the moving rod is hinged to a second pull rod, one end of the second pull rod away from the first pull rod is rotationally connected to a push rod, and both ends of the push rod along its longitudinal axis are fixedly connected to the two movable plates, respectively;

the second U-shaped plate member slides on the right-angle sliding plates in a direction parallel to the first driving rod.

4. The right-angle needle-punching mechanism according to claim 3, wherein a sliding slot parallel to the first driving rod is provided on an outer surface of a side plate of the second U-shaped plate member, and a support rail that matches the sliding slot is provided on an inner surface of the right-angle sliding plates.

5. A needle-punching device, including a base and a main frame fixed to the base, wherein the main frame is provided with an upper needle-punching mechanism for performing needle punching on an upper surface of a preform, a lateral needle-punching mechanism for performing needle punching on a side surface of the preform, and the right-angle needle-punching mechanism as claimed in claim 1 for performing the needle punching on the right-angle part of the preform.

6. The needle-punching device according to claim 5, wherein the lateral needle-punching mechanism is symmetrically arranged on the main frame, and the right-angle needle-punching mechanism is symmetrically arranged on the main frame.

7. The needle-punching device according to claim 5, wherein the lateral needle-punching mechanism includes at least one lateral cylinder that is horizontally disposed, at least one lateral push rod, and a lateral needle plate, the at least one lateral cylinder is fixed to a lateral sliding plate, and the lateral sliding plate approaches or moves away from a needle-punching mold under an action of a lateral adjustment cylinder fixed and horizontally provided on the main frame.

8. The needle-punching device according to claim 5, wherein the needle-punching device further includes a moving platform that supports and drives a needle-punching mold, the moving platform includes a platform body, a guide groove is provided on a bottom surface of the platform body, the guide groove cooperates with a moving guide rail provided on the base to enable the platform body to move along the moving guide rail to adjust a needle-punching position of the preform.

* * * * *